US010054364B2

(12) United States Patent
Berberich et al.

(10) Patent No.: US 10,054,364 B2
(45) Date of Patent: Aug. 21, 2018

(54) MELTING APPARATUS FOR METERED MELTING OF PARAFFIN

(71) Applicant: LEICA BIOSYSTEMS NUSSLOCH GMBH, Nussloch (DE)

(72) Inventors: Markus Berberich, Heidelberg (DE); Hermann Ulbrich, Bad Schönborn-Mingolsheim (DE); Florian Böhl, Neckargemünd (DE); Ralf Eckert, Schriesheim (DE); Karin Flieger, Seeheim-Jugenheim (DE)

(73) Assignee: Leica Biosystems Nussloch GmbH, Nussloch (DE)

( * ) Notice: Subject to any disclaimer, the term of this patent is extended or adjusted under 35 U.S.C. 154(b) by 0 days.

(21) Appl. No.: 15/435,755

(22) Filed: Feb. 17, 2017

(65) Prior Publication Data

US 2017/0241712 A1 Aug. 24, 2017

(30) Foreign Application Priority Data

Feb. 18, 2016 (DE) ..... 10 2016 202 560

(51) Int. Cl.

| | |
|---|---|
| ***F27B 17/02*** | (2006.01) |
| ***F27B 14/06*** | (2006.01) |
| ***F27B 14/08*** | (2006.01) |
| ***F27D 21/00*** | (2006.01) |

(52) U.S. Cl.

CPC ..... *F27B 17/02* (2013.01); *F27B 14/06* (2013.01); *F27B 14/0806* (2013.01); *F27D 21/0028* (2013.01); *F27D 21/0035* (2013.01); *F27M 2001/00* (2013.01)

(58) Field of Classification Search

CPC .. F27B 17/02; F27B 14/0806; F27D 21/0028; F27D 21/0035

See application file for complete search history.

(56) References Cited

U.S. PATENT DOCUMENTS

| | | | | |
|---|---|---|---|---|
| 7,191,807 | B2 * | 3/2007 | DeMaison | G03G 15/0894 141/302 |
| 2008/0035667 | A1 * | 2/2008 | Valenti | A61J 3/07 222/1 |
| 2010/0167038 | A1 | 7/2010 | Linnenbrink | |

FOREIGN PATENT DOCUMENTS

| | | | |
|---|---|---|---|
| CN | 204247172 | U | 4/2015 |
| EP | 0331768 | A1 | 9/1989 |
| JP | H09181704 | A | 7/1997 |

* cited by examiner

*Primary Examiner* — Timothy L Maust
*Assistant Examiner* — Timothy P Kelly
(74) *Attorney, Agent, or Firm* — Hodgson Russ LLP

(57) ABSTRACT

The invention relates to a melting apparatus (100) for melting paraffin (1), having: a melting container (110) for receiving paraffin (1) to be melted; a storage container (190) for storing molten paraffin (4); having a melting container heating device (120) for heating the melting container (110), having a storage container heating device (191) for heating the storage container (190), having a fluid connection (113) fluidically connecting the melting container (110) and the storage container; the melting container (110), the storage container (190), and the fluid connection (113) being arranged so that molten paraffin (4) flows out of the melting container (110) into the storage container (190).

14 Claims, 3 Drawing Sheets

MELTING APPARATUS FOR METERED MELTING OF PARAFFIN

CROSS REFERENCE TO RELATED APPLICATIONS

Figure 1:
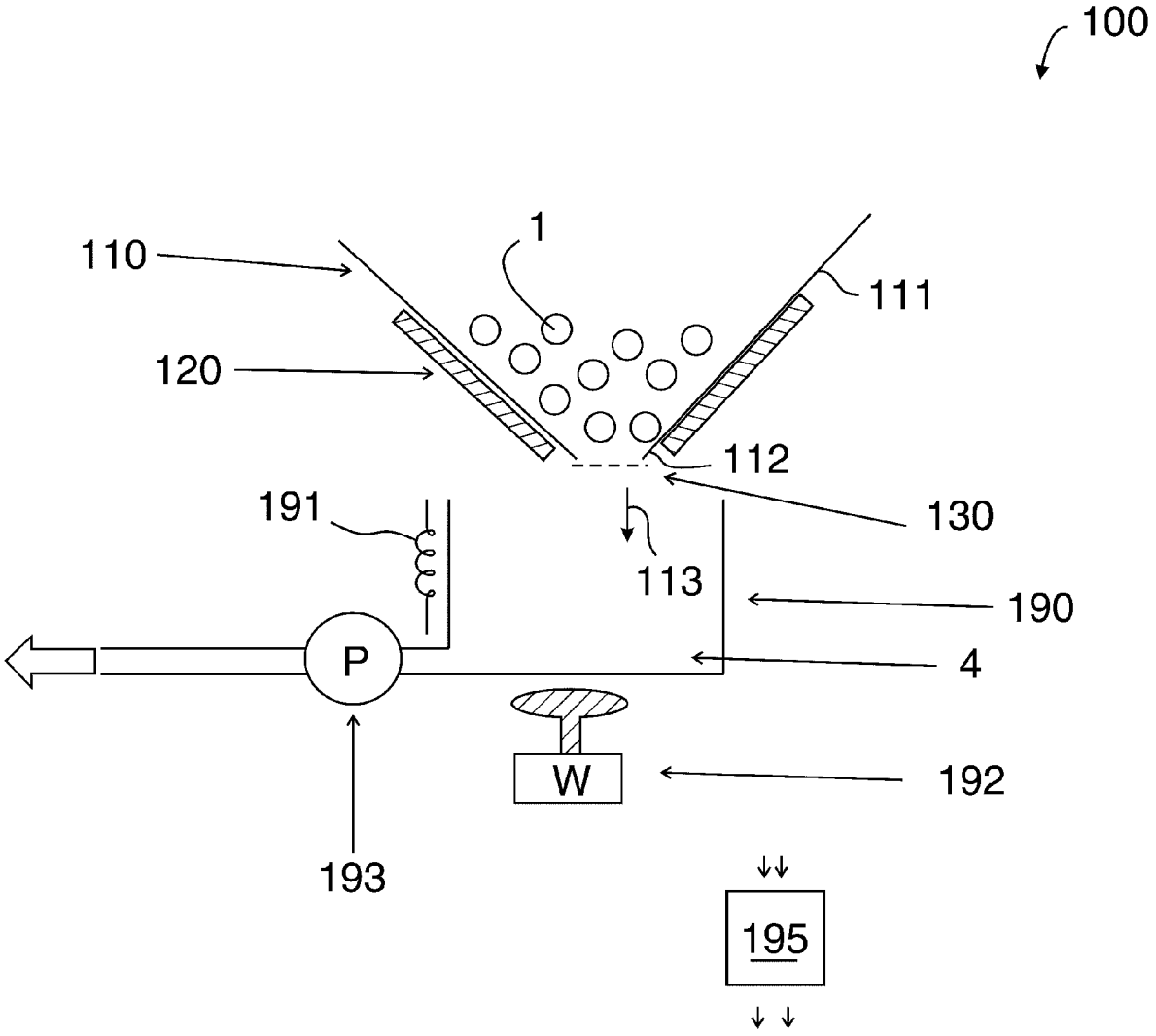

This application claims priority of German patent application number 10 2016 202 506.0 filed Feb. 18, 2016, the entire disclosure of which is incorporated by reference herein.

FIELD OF THE INVENTION

The present invention relates to a laboratory device having a melting apparatus for melting paraffin, and to a use of such a melting apparatus for melting paraffin.

BACKGROUND OF THE INVENTION

DE 102 23 304 A1 discloses an apparatus for embedding samples in paraffin, having a pouring station and a reservoir container for the paraffin. The reservoir container is equipped with a heating device for melting paraffin in solid form. Here all of the paraffin is melted, and stored in a molten state during operation.

DE 10 2008 054 071 A1 describes a tissue processor for processing tissue samples. The processor comprises, besides several chemical tanks, containers for liquid paraffin as well as a reservoir station for melting paraffin pellets or paraffin flakes. Molten paraffin can be pumped via conduits from the reservoir station into the containers.

WO 2006/089365 A1 discloses a tissue processor having a reservoir container whose floor is equipped with a heating element, for melting paraffin blocks. The paraffin blocks can be stacked on one another, at first only the lower block being melted. Contact between the lower paraffin block and the heated floor is ensured by a weight on the paraffin blocks. A heating mandrel projecting into the melting container is furthermore provided as an additional heating element.

US 2010/0167038 A1 discloses a melting apparatus for melting materials based on polyester, polyamide, polyolefin, or the like, by means of which apparatus motor vehicles can be coated with those materials. For this, the material is melted in a melting container and then conveyed into a storage container.

EP 0 331 768 A1 discloses an apparatus for melting adhesive, in which a melting container is heated and the adhesive is then withdrawn therefrom by means of a pump.

The known melting apparatuses are disadvantageous in that melting takes a relatively long time, and in the meantime it is not possible to withdraw liquid paraffin. Proceeding from this existing art, the intention is to shorten the melting time.

SUMMARY OF THE INVENTION

The present invention proposes a laboratory device having a melting apparatus for melting paraffin, and a use of such a melting apparatus, having the features of the independent claims. Advantageous embodiments are the subject matter of the dependent claims and of the description that follows.

In the context of the invention, a melting apparatus for melting paraffin, having a heated melting container for receiving paraffin to be melted and a heated storage container for storing molten paraffin, is presented, molten paraffin being capable of flowing out of the melting container into the storage container. In particular, the paraffin does not need to be pumped into the storage container. Thanks to the provision of two special containers, both melting and the delivery of paraffin to be melted, on the one hand, and the withdrawal of molten paraffin, on the other hand, can take place mutually independently and, in particular, simultaneously. It is not necessary to melt all the paraffin present in the melting container. Melting time and energy consumption are thereby reduced. The invention makes it possible for exactly a desired or predefinable quantity of molten paraffin always to be on hand in the storage container without requiring a great deal of energy for the purpose.

The invention is used in laboratory devices, such as tissue processors (cf. WO 2006/089365 A1, DE 10 2008 054 071 A1, WO 2005/116609 A1) or automatic embedding machines (cf. DE 102 23 304 A1, DE 10 2007 022 014 A1).

A very practical solution that is of simple design results if the melting container comprises an outflow to which a fluid conduit fluidically connecting the melting container and the storage container is connected. The molten paraffin can thereby always flow in very simple and direct fashion out of the melting container into the storage container. The outflow can comprise a valve in order to block the fluid connection.

An outflow of this kind preferably likewise having a downward sloping floor, and/or a withdrawal pump, can likewise be provided for withdrawal of the molten paraffin from the storage container.

According to the present invention the storage container comprises a measuring device for measuring the weight or volume of the molten paraffin. It is thereby possible in particular to implement a fill level monitoring function that allows exactly a desired or definable quantity of molten paraffin always to be on hand in the storage container. For example, if a value falls below a lower threshold value, a melting container heating device is activated and/or a valve between the melting container and storage container is opened. For example, when an upper threshold value is reached or exceeded, the melting container heating device can be deactivated and/or the valve can be closed.

According to a preferred embodiment, the melting container comprises a floor that slopes downward toward the outflow. The molten paraffin can thereby reach the outflow independently and with no pumps or the like. For example, the floor can comprise a funnel-shaped and/or obliquely extending portion, or can be configured overall in a funnel shape or in the form of an oblique plane or a pyramid standing on its tip, or the like.

Usefully, the melting container comprises a measuring device for measuring the weight and/or volume of the paraffin to be melted. As a result, the operator of the melting apparatus can be informed in timely fashion, for example by means of warning messages and/or warning signals, that paraffin to be melted is running short and must be refilled. Alternatively or additionally, automatic refilling from a reservoir container can also occur, for example by means of an automatic transport device (e.g. screw conveyor system) or bulk fill apparatus.

The melting container heating device and/or the storage container heating device preferably comprise an inductor for inducing eddy currents in a floor and/or a wall of the container and/or in metallic bodies that are received in the container. Inductive heating has better efficiency and faster response times than resistance heating. The melting container heating device and/or storage container heating device can nevertheless also comprise one or more resistance heating elements.

The melting container heating device is preferably arranged in the region of the outflow so that (only) the region around the outflow, for example the downward sloping region of the container floor, becomes heated. For example, the floor can be metallic at least in the region of the outflow, and can be heated inductively and/or by means of a resistance heating element. Because only a limited quantity of liquid paraffin is ever withdrawn from the melting container into the storage container in order to fill the latter, it is in particular not necessary to heat the entire melting container.

In contrast thereto, the entirety of the storage container is preferably heated, for example by way of a (resistance- and/or inductively) heated floor or outer walls, and/or heating coils in the container. In particular, heating or warming of the molten paraffin in the storage container can make use of the feature of inductively heating a container floor and/or container walls, or arranging the liquid paraffin and metallic bodies in the storage container and then inductively heating the metallic bodies. Thanks to the extensive distribution of the metallic bodies in the liquid paraffin, the latter is heated not only from outside as in the case of conventional melting methods, but in its bulk, which is appreciably more energy-efficient.

The metallic bodies preferably encompass particles and/or spheres and/or grid strips and/or ferromagnetic bodies, e.g. comprising iron, cobalt, nickel, and/or rare earths, and/or have a volume of less than 5 $mm^3$, in particular of 2 to 3 $mm^3$. The metallic bodies are preferably made of a non-corroding metal or have a coating made of a non-corroding metal.

The metallic bodies preferably encompass metallic bodies mounted or inserted in the storage container, e.g. inserted, suspended, and/or skewered spheres and/or an inserted or mounted grid or the like. The volume of mounted or inserted metallic bodies is usefully greater than the volume of loose bodies. Provision can be made that the mounted bodies are mounted in the storage container detachably, for example for cleaning purposes. The metallic bodies can thus be reused, which makes this alternative very inexpensive.

Further advantages and embodiments of the invention are evident from the description and the appended drawings.

It is understood that the features recited above and those yet to be explained below are usable not only in the respective combination indicated, but also in other combinations or in isolation, without departing from the scope of the present invention.

The invention is schematically depicted in the drawings on the basis of an exemplifying embodiment, and will be described in detail below with reference to the drawings.

BRIEF DESCRIPTION OF THE DRAWING VIEWS

FIG. 1 very schematically shows an embodiment in principle of a melting apparatus according to the present invention.

Figure 2:
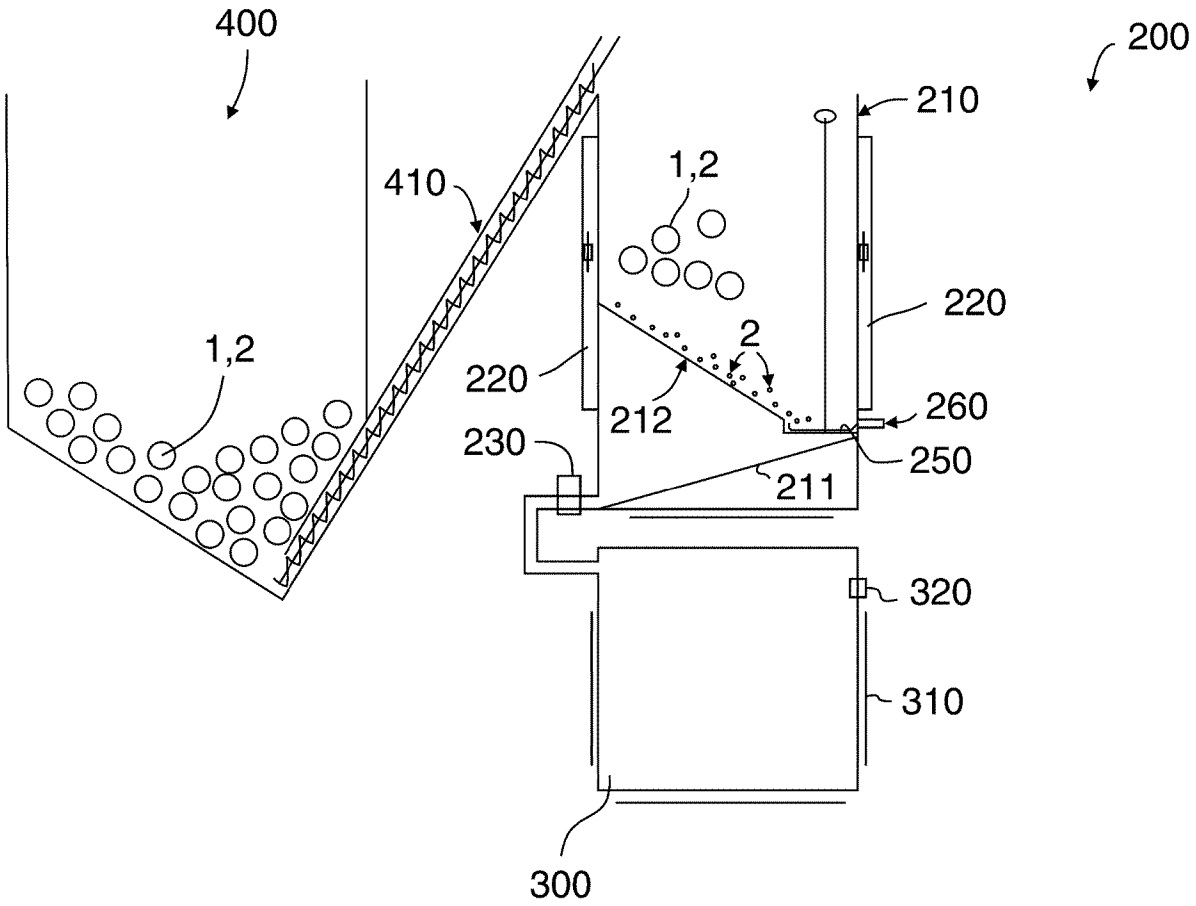

FIG. 2 very schematically shows a further preferred embodiment of a melting apparatus according to the present invention.

Figure 3:
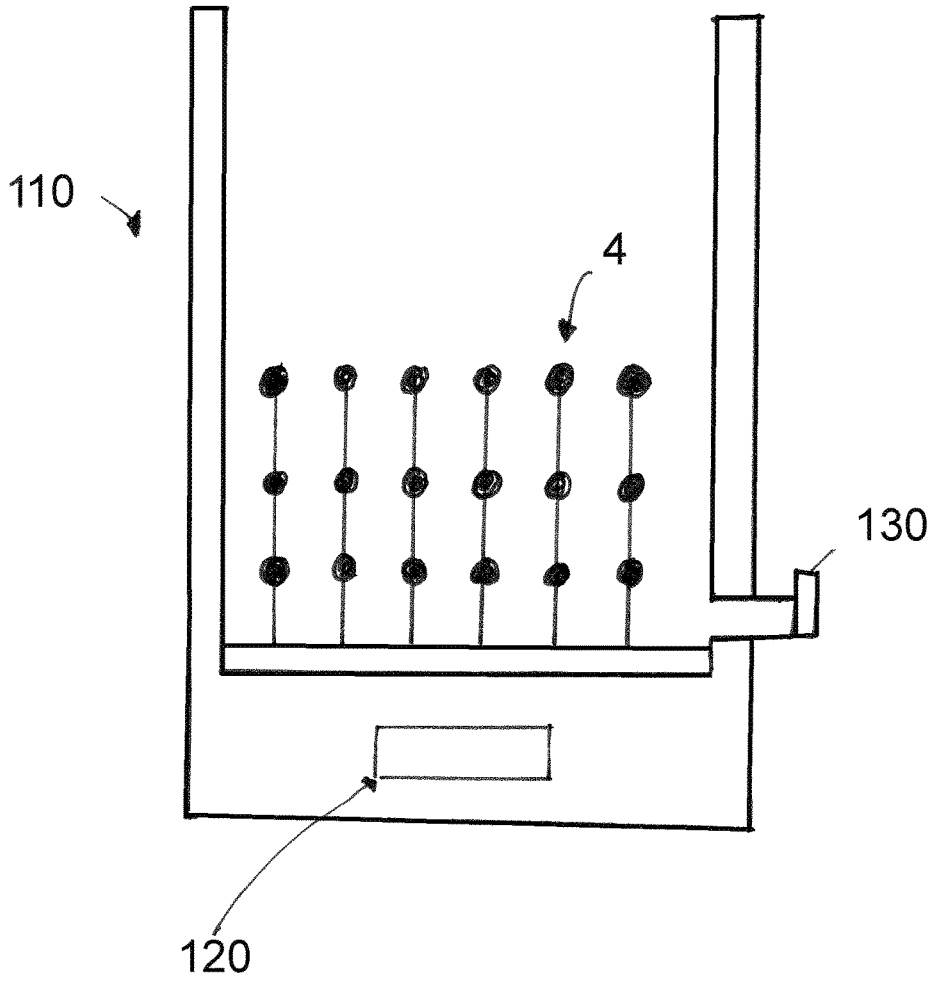

FIG. 3 very schematically shows an alternative embodiment of a melting container for a preferred embodiment of a melting apparatus according to the present invention.

DETAILED DESCRIPTION OF THE INVENTION

FIG. 1 very schematically shows an embodiment of a melting apparatus according to the present invention, which is labeled 100 in its entirety.

Melting apparatus 100 comprises a melting container 110 for the reception of paraffin 1 to be melted, and a storage container 190 for storing molten paraffin 4. The paraffin can be introduced or poured into melting container 110, for example, in the form of blocks or plates, pieces, beads, pellets, flakes, etc.

Melting container 110 comprises a floor having a funnel-shaped portion 111 that slopes downward toward an outflow 112. A sieve 130 for retaining solid paraffin 1 is arranged at the outflow. A valve for blocking a fluid connection 113 between melting container 110 and storage container 190 can also be provided.

With this embodiment it would also be conceivable to use funnel-shaped paraffin blocks.

Melting container 110 is heated by a melting container heating device, configured here as a resistance heating element, in the region around outflow 112. Paraffin melting on the heated portion 111 can thus flow downward (in the Figure) to outflow 112, and from there to storage container 190.

An alternative embodiment of a melting container 110 is depicted in FIG. 3. Metallic bodies 4 are arranged in melting container 110 together with paraffin 1 to be melted. The metallic bodies can in particular be embedded as metallic particles in paraffin 1 to be melted, and/or they can be mounted in melting container 110, for example in the form of an arrangement 4 of lined-up or skewered spheres or the like.

In order to induce eddy currents in metallic bodies 4, the melting apparatus comprises at least one inductor 120 that can be embodied in particular in the form of a flat induction coil. Inductor 120 is arranged below a floor of melting container 110.

For withdrawal or release of the molten paraffin into storage container 190, melting container 110 comprises an opening having an optional valve 130.

Storage container 190 is heated by a storage container heating device 191 that is embodied, for example, as an inductor or induction coil that heats a metallic floor and/or metallic walls of storage container 190, and/or metallic bodies arranged inside storage container 190. Storage container heating device 191 can also comprise at least one resistance heating element.

A weighing device 192 (W) is provided in order to measure the weight of molten paraffin 4 in storage container 190.

Weighing device 192 can be in communication with a control device 195 that is embodied to control melting container heating device 120 and/or a valve preferably arranged between melting container 110 and storage container 190. When control device 195 recognizes that the quantity or mass of molten paraffin 4 has reached or fallen below a predefinable threshold value, control device 195 can preferably be configured to activate melting container heating device 120 and/or to open a valve (e.g. 130 in FIG. 3) that is present. When control device 195 recognizes that the quantity of molten paraffin 4 has reached or exceeded a predefinable upper threshold, control device 195 can preferably be configured to deactivate melting container heating device 120 and/or to close the valve.

A pump 193 (P) is provided for withdrawing molten paraffin 4 from storage container 190.

FIG. 2 very schematically depicts a further preferred embodiment of a melting apparatus 200 according to the present invention. Melting apparatus 200 comprises a melting container 210 in which paraffin 1 to be melted, and metallic bodies 2, are arranged. Melting apparatus 200 furthermore comprises inductors, embodied as coil windings 220, which are arranged behind a side wall of melting container 210. The coil windings can be guided, for example, around melting container 210 as a cylindrical coil, or can be arranged as flat coils next to, for example, planar side walls.

In the illustration depicted, melting container 210 comprises an oblique floor 211 that is tilted toward an outflow having a valve 230. This configuration serves to allow very easy withdrawal of the molten paraffin from melting container 210 by opening a valve 230.

Arranged downstream from the valve is a storage container 300 for molten paraffin, which is also heated, for example by means of conventional resistance heating elements 310. A fill level sensor 320 of storage container 300 serves to detect the fill level of the molten paraffin and, for example, can interact with valve 230 in such a way that valve 230 opens as soon as the fill level of the molten paraffin in storage container 300 reaches or falls below a predefinable lower threshold value, and/or closes as soon as the fill level of the molten paraffin in storage container 300 reaches or exceeds a predefinable upper threshold value.

Melting container 210 comprises a separation apparatus embodied as a detachable sieve 250, so that loose metallic particles 2 can be withdrawn from melting container 210. An oblique intermediate floor 211 serves to guide the loose metallic bodies 2 into separation apparatus 250, which can have a trough shape for collection of the loose metallic bodies. Intermediate floor 211 can be permeable to the paraffin.

A sensor 260 for determining the quantity of loose metallic bodies 2 can be provided in order to ensure timely withdrawal of the metallic bodies.

Melting apparatus 200 furthermore comprises a reservoir container 400 for paraffin 1 that is to be melted and has embedded metallic bodies 2, from which container paraffin 1 that is to be melted and has embedded metallic bodies 2 can be conveyed via a feeder, e.g. a screw conveyor system 410, into melting container 210.

Metallic bodies 2 are embodied, for example, as ferromagnetic particles that are embedded into the fragmented, in particular spherical or substantially spherical, paraffin. The size of metallic particles 2 is preferably in a range from 2 to 3 $mm^3$.

Ferromagnetic metallic bodies can be heated more easily by induction than non-ferromagnetic ones, and in particular can also be collected and disposed of, after melting, using a magnet.

What is claimed is:

1. A laboratory device having a melting apparatus (100, 200) for melting paraffin (1), the melting apparatus (100, 200) comprising:

a melting container (110, 210) for receiving paraffin (1) to be melted;

a plurality of metallic bodies (2) received in the melting container (110, 210), wherein each of the plurality of metallic bodies received in the melting container is embedded in the paraffin (1) or mounted in the melting container (110, 210);

a storage container (190) for storing molten paraffin (4);

a melting container heating device (120) for heating the melting container (110, 210), the melting container heating device (120, 220) comprising an inductor for inducing eddy currents in the plurality of metallic bodies (2) received in the melting container (110, 210);

a storage container heating device (191) for heating the storage container (190);

a fluid connection (113) fluidically connecting the melting container (110, 210) and the storage container;

wherein the melting container (110, 210), the storage container (190), and the fluid connection (113) are arranged so that molten paraffin (4) flows out of the melting container (110, 210) into the storage container (190); and wherein the storage container (190) includes a measuring device (192, 320) for measuring the weight or volume of the molten paraffin (4) in the storage container (190).

2. The laboratory device according to claim 1, the melting container (110, 210) comprising an outflow (112) from which the fluid connection (113) proceeds.

3. The laboratory device according to claim 2, the outflow (112) comprising a valve (230).

4. The laboratory device according to claim 2, the melting container (110, 210) comprising a floor (111) that slopes downward toward the outflow (112).

5. The laboratory device according to claim 4, the floor (111) comprising a funnel-shaped portion.

6. The laboratory device according to claim 1, wherein the laboratory device is configured to keep a predefinable quantity of molten paraffin on hand in the storage container (190).

7. The laboratory device according to claim 1, further comprising a withdrawal pump (193) and/or an outflow for withdrawing molten paraffin (4) from the storage container (190).

8. The laboratory device according to claim 1, the melting container (110, 210) comprising a measuring device for measuring the weight and/or volume of the paraffin to be melted.

9. The laboratory device according to claim 1, wherein the inductor induces eddy currents in a floor and/or a wall of the melting container (110, 210).

10. The laboratory device according to claim 1, the melting container heating device (120, 220) comprising a resistance heating element.

11. The laboratory device according to claim 1, the storage container heating device (191, 310) comprising an inductor for inducing eddy currents in a floor and/or a wall of the storage container (190, 300).

12. The laboratory device according to claim 1, further comprising a plurality of metallic bodies (2) received in the storage container (110, 210), wherein each of the plurality of metallic bodies received in the storage container is embedded in the paraffin (1) or mounted in the storage container (110, 210), the storage container heating device (191, 310) comprising an inductor for inducing eddy currents in the metallic bodies (2) received in the storage container (190, 300).

13. The laboratory device according to claim 1, the storage container heating device (191, 310) comprising a resistance heating element.

14. A laboratory device having a melting apparatus (100, 200) for melting paraffin (1), the melting apparatus (100, 200) comprising:

a melting container (110, 210) for receiving paraffin (1) to be melted;

a storage container (190, 300) for storing molten paraffin (4);

a plurality of metallic bodies (2) received in the storage container (190, 300), wherein each of the plurality of metallic bodies received in the storage container is embedded in the paraffin (1) or mounted in the storage container (190, 300);

a melting container heating device (120) for heating the melting container (110, 210);

a storage container heating device (191, 310) for heating the storage container (190, 300), the storage container heating device (191, 310) comprising an inductor for inducing eddy currents in the plurality of metallic bodies (2) received in the storage container (190, 300);

a fluid connection (113) fluidically connecting the melting container (110, 210) and the storage container;

wherein the melting container (110, 210), the storage container (190, 300), and the fluid connection (113) are arranged so that molten paraffin (4) flows out of the melting container (110, 210) into the storage container (190, 300); and wherein the storage container (190, 300) includes a measuring device (192, 320) for measuring the weight or volume of the molten paraffin (4) in the storage container (190, 300).

* * * * *